United States Patent [19]

Wichman

[11] 4,177,944

[45] Dec. 11, 1979

[54] ROTARY IRRIGATION SPRINKLER

[75] Inventor: William J. Wichman, Glendora, Calif.

[73] Assignee: Rain Bird Sprinkler Mfg. Corp., Glendora, Calif.

[21] Appl. No.: 933,987

[22] Filed: Aug. 16, 1978

[51] Int. Cl.[2] ..... B05B 3/14
[52] U.S. Cl. ..... 239/230
[58] Field of Search ..... 239/230, 231, 233

[56] References Cited

U.S. PATENT DOCUMENTS

| | | | |
|---|---|---|---|
| 1,547,084 | 7/1925 | Todd et al. | 239/230 |
| 2,214,990 | 9/1940 | Buckner | 239/230 |
| 2,310,796 | 2/1943 | Lappin | 239/230 |
| 2,981,482 | 4/1961 | Warren | 239/230 |

*Primary Examiner*—Robert W. Saifer
*Attorney, Agent, or Firm*—Filwider, Patton, Rieber, Lee & Utecht

[57] ABSTRACT

A rotary irrigation sprinkler of the impact drive type is provided wherein a stream deflector for driving the sprinkler is supported adjacent the outlet of the sprinkler at one end of an elongated spring, the other end of the spring being secured to the sprinkler body.

10 Claims, 3 Drawing Figures

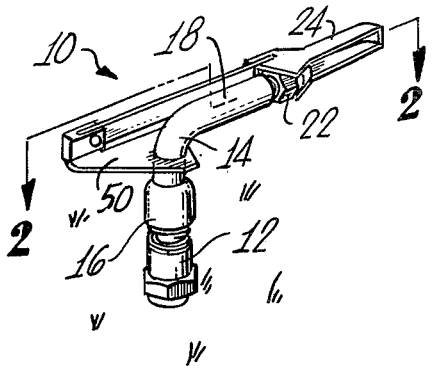
Fig. 1
Fig. 2
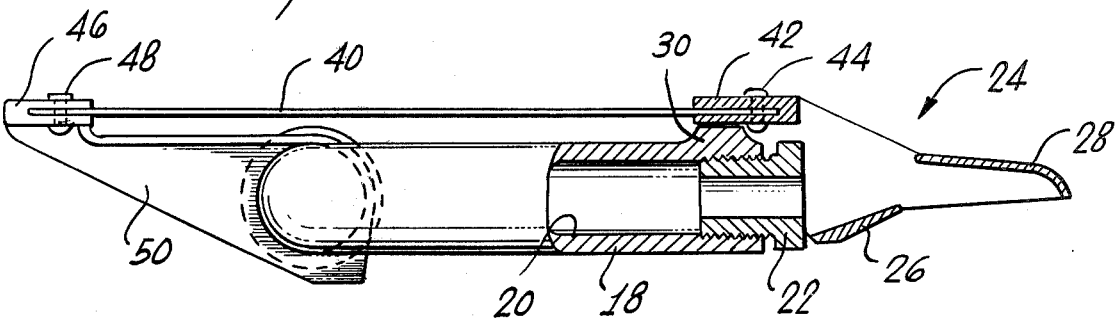
Fig. 3
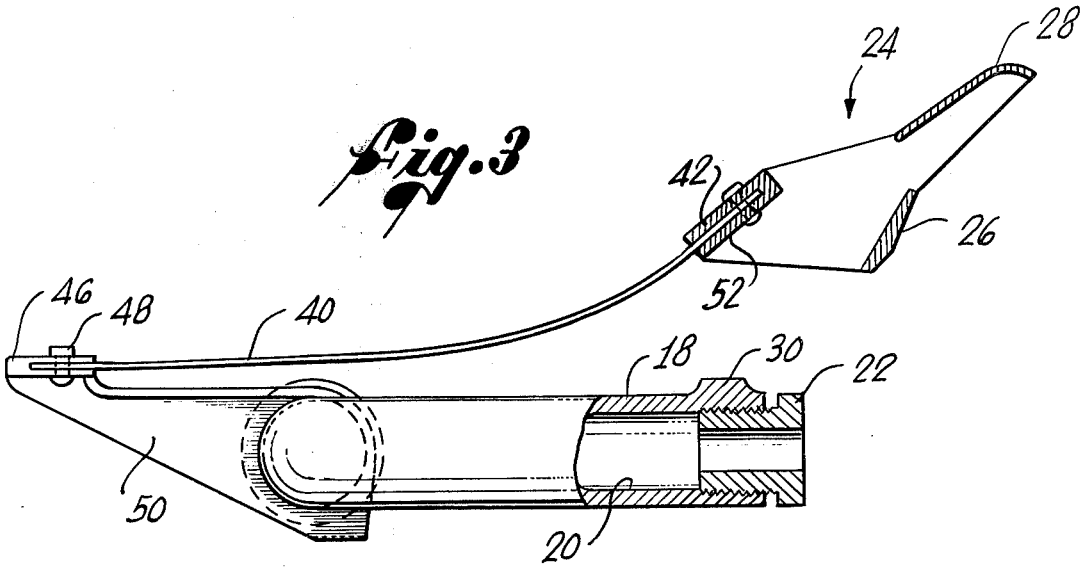

ROTARY IRRIGATION SPRINKLER

BACKGROUND OF THE INVENTION

This invention relates generally to irrigation sprinklers, and, more particularly, to a means for imparting rotary motion to such sprinklers.

The most widely used type of rotary sprinkler includes an oscillating arm having a water deflector at one end arranged to intermittently enter a stream of water ejected by the sprinkler. In an impact drive sprinkler, the arm strikes the body of the sprinkler thereby imparting an increment of rotary motion to the sprinkler, and repeated oscillation of the arm causes the sprinkler to rotate.

The oscillating arm of an impact drive sprinkler includes a centrally upstanding bearing journaled on a vertically disposed pivot pin which is secured to the body of the sprinkler. In order to bias the deflector into the stream of water, a coil spring surrounds the centrally upstanding bearing and is attached at one end to the body of the sprinkler and at the other end to the oscillating arm.

Although the above described devices function satisfactorily, the pivot pin and bearing subject to wear and therefore have a limited useful life. Further, the coil spring must be assembled about the pivot pin and bearing and secured to the body and oscillating arm by hand. In mass production, this time consuming and sometimes difficult operation adds significantly to the cost of manufacturing such sprinklers. Moreover, in order to properly secure the pivot pin to the body while providing the space required for a coil spring, an open frame or bridge portion is generally included on top of the body and adds further to the material required, and therefore to the cost of producing the sprinkler.

Accordingly, there has existed a need for a convenient and effective device for imparting rotational movement to an impact drive sprinkler, which is relatively inexpensive to manufacture and provides an enhanced wear life of the sprinkler with which it is used. As will become apparent from the following, the present invention satisfies that need.

SUMMARY OF THE INVENTION

The present invention provides a simplified irrigation sprinkler construction which substantially reduces the cost of manufacturing such sprinklers, and which significantly enhances the effective wear life of such sprinklers. Moreover, the sprinkler construction of the present invention is trouble-free and reliable in use, and attains its improved characteristics without requiring a bearing mounted oscillating arm or a relatively weak and easily damaged coil spring.

More specifically, the sprinkler of the present invention includes a water deflector for imparting rotational movement to the sprinkler, the deflector being mounted on one end of an elongated spring which is secured at its other end to the body of the sprinkler. Further, the spring is rigidly mounted on the sprinkler body, biases the deflector into the stream of water ejected from the sprinkler, and provides the sole means of support of the deflector on the sprinkler. By this arrangement, no frictionally wearing bearing is required to mount the deflector for movement into and out of the stream of water, and the assembly of the present invention is greatly simplified thereby significantly decreasing the cost of producing the sprinkler.

In the preferred embodiment of the present invention, the elongated spring is a leaf spring mounted in a position substantially parallel to the stream of water emerging from the sprinkler and oriented in a generally vertical plane to resist twisting during lateral deflection. If desired, an arm can be provided on the body extending in a direction generally opposite to the direction of the emerging stream of water, and the spring can be secured to the distal end of the extending arm.

Other features and advantages of the present invention will become apparent from the following detailed description, taken in conjunction with the accompanying drawings, which illustrate, by way of example, the principles of the invention.

BRIEF DESCRIPTION OF THE DRAWINGS

FIG. 1 is a perspective view of the sprinkler of the present invention;

FIG. 2 is an enlarged, partly sectional view of the sprinkler of the present invention and taken substantially along line 2—2 of FIG. 1; and FIG. 3 is an enlarged, partly sectional view of the sprinkler, similar to the view of FIG. 2, and illustrating the stream deflector in its deflected position.

DETAILED DESCRIPTION

As shown in the exemplary drawings, the present invention is embodied in a drive mechanism for use with a rotary irrigation sprinkler of the impact drive type indicated generally by reference numeral 10 in FIG. 1. In this instance, the sprinkler 10 is mounted for rotation about a vertical axis on a water supply pipe or riser 12, and includes a main body 14 having a lower inlet portion 16. Extending upwardly and outwardly from the inlet portion 16 of the body 14 is a water ejecting tube 18 having an internal conduit 20 (FIG. 2) through which water travels to a nozzle 22.

When in use, water is admitted under supply pressure into the sprinkler 10 through the riser 12, and travels through the internal conduit 20 in the tube 18 to the nozzle 22 which ejects the water upwardly and outwardly away from the sprinkler 10. To drive the sprinkler, a stream deflector, indicated generally by reference numeral 24 in FIG. 2, is mounted on the sprinkler adjacent the outlet of the nozzle 22 in a manner which will be described in greater detail hereinafter. The stream deflector 24 includes an inner water deflecting vane 26 and an outer water deflecting spoon 28 disposed at the end thereof.

The operation of the stream deflector 24 to drive the sprinkler 10 is well known in the art, and it is not believed necessary to describe that operation in detail here. It is sufficient for the purposes of this invention to point out that during the operation of the sprinkler 10, the water deflecting vane 26 and spoon 28 intermittently enter the stream of water ejected from the nozzle 22 causing the stream deflector 24 to impact against a boss 30 formed on the tube 18 thereby imparting to the sprinkler 10 an increment of rotational movement.

In accordance with the present invention, the sprinkler 10 is rotated about a vertical axis by the cooperative action of the stream of water ejected from the sprinkler and the stream deflector 24 which is attached to the sprinkler body 14 by an elongated flexible spring 40. Further, the sprinkler of the present invention is relatively inexpensive to manufacture and is capable of operating in an effective and reliable manner without requiring a separate rotationally swinging counterweighted arm or the attendant coiled arm spring.

For mounting the deflector 24 adjacent the outlet of the sprinkler 10, the deflector includes a sleeve 42 for receiving one end of the spring 40. The sleeve is sized to cooperate with the external shape of the spring, and the sleeve and spring are secured together by any suitable fastening device such as a rivet 44.

The opposite end of the spring 40 is rigidly secured to the body 14 by being received in a spring mounting 46 which is secured to, or formed integrally with, the body 14. For receiving the spring 40, the spring mounting 46 can include a sleeve portion, similar to the sleeve 42 on the deflector 24, and a rivet 48 can be used to secure the spring to the mounting.

In the preferred embodiment of the present invention, the spring mounting 46 is arranged at the end of an arm 50 extending from the body 14 in a direction substantially opposite to the direction of the tube 18. By this arrangement, the spring 40 can be secured to the mounting 46 and extend along and substantially parallel to the tube 18 for supporting the deflector 24 adjacent the outlet of the sprinkler 10.

In operation of the sprinkler of the present invention, with the deflector 24 in the position illustrated in exemplary FIG. 2, the stream of water ejected from the nozzle 22 is directed by the vane 26 into the spoon 28 which deflects the stream laterally. The lateral deflection of the stream creates a reaction force which tends to rotate the deflector 24 in a counterclockwise direction to the position shown in exemplary FIG. 3, or some other angular position depending upon the force of the stream of water.

This counterclockwise rotation of the deflector 24 is resisted by the spring 40, and when the rotational momentum of the deflector has been dissipated, the spring 40 forces the deflector 24 from the position shown in FIG. 3 toward the position shown in FIG. 2. Sufficient energy is stored in the spring 40 to cause a striking pad 52 on the sleeve 42 to impact against the boss 30 on the tube 18 and impart an increment of rotational movement to the sprinkler 10. Repeated oscillation of the deflector 24 between the positions illustrated in FIGS. 2 and 3 causes the sprinkler 10 to rotate about its vertical axis.

The oscillation rate of the deflector 24 is determined by the length of the spring 40, with a longer spring producing a slower oscillation rate. Accordingly, the length of the arm 50 and the characteristics of the spring 40 may be chosen to product the desired oscillation rate of the deflector 24. Further, it has been found desirable to employ a flat leaf type spring oriented in a generally vertical plane to resist any tendency of the deflector 24 to twist during its deflection out of the stream of water.

From the foregoing, it will be appreciated that the sprinkler of the present invention provides a mechanism for achieving rotational motion of the sprinkler which mechanism has a substantially simplified construction. Moreover, the sprinkler of the present invention is trouble free and reliable in use, and its simplified construction substantially reduces the time and cost required to produce prior rotary impact drive sprinklers.

While a particular form of the invention has been illustrated and described, it will be apparent that various modifications can be made without departing from the spirit and scope of the invention.

I claim:

1. A rotary irrigation sprinkler comprising:

a body member mounted for rotation about a substantially vertical axis;

means for periodically impacting said body member thereby imparting to said body member an increment of rotational movement about said vertical axis, said means deriving said rotational movement from a stream of water ejected from said sprinkler;

said means for impacting being supported on a first end of a flexible arm of inherent resiliency; and a second opposite end of said flexible arm means being secured to said body member.

2. A sprinkler as defined in claim 1 wherein said elongated spring means is a leaf spring.

3. A sprinkler as defined in claim 2 wherein said leaf spring is disposed in a vertical plane and resists twisting movement of said means for impacting.

4. A rotary irrigation sprinkler comprising:

a body member, including an inlet for receiving a stream of irrigation water and an outlet for ejecting said stream of water from said sprinkler, mounted for rotation about a substantially vertical axis;

means for periodically impacting said body member thereby imparting to said body member an increment of rotational movement about said vertical axis;

said means for impacting being supported on a first end of an elongated spring means supporting said means for impacting adjacent said outlet; and a second opposite end of said spring means secured to said body member adjacent said inlet.

5. A sprinkler as defined in claim 4 wherein said means for impacting is a water deflector biased by said spring means to move into said stream of water ejected from said outlet for impacting said body member, said deflector arranged to cooperate with said stream of water to move out of said stream against the force of said spring.

6. A sprinkler as defined in claim 4 including an arm extending from said body oppositely of said outlet, said second end of said spring means being secured adjacent the distal end of said arm.

7. An apparatus for imparting rotation to an irrigation sprinkler having a body and a nozzle for ejecting a stream of water, said apparatus comprising:

an elongated spring secured at one end to said body;

a deflector extending from said elongated spring alone and free of other supporting structure, said deflector being urged by said spring into the stream of water, having a water deflecting surface to produce a force opposing said spring and causing movement of said deflector out of the stream and corresponding deflection of said spring; and means on said body periodically engaged by said deflector to cause incremental rotation of said sprinkler.

8. An apparatus as defined in claim 7 including an arm extending from said body oppositely of said nozzle, said one end of said spring being secured to said arm adjacent the distal end thereof.

9. An apparatus for imparting rotation to an irrigation sprinkler having a body and a nozzle for ejecting a stream of water, said apparatus comprising:

an elongated leaf spring secured at one end to said body;

a deflector extending from said elongated spring and urged by said spring into the stream of water, said deflector having a water deflecting surface to produce a force opposing said spring and causing movement of said deflector out of the stream and corresponding deflection of said spring; and means on said body periodically engaged by said deflector to cause incremental rotation of said sprinkler.

10. An apparatus as defined in claim 9 wherein said leaf spring is disposed in a vertical plane and resists twisting movement of said deflector.

* * * * *